US005183171A

United States Patent [19]

Pherigo

[11] Patent Number: 5,183,171

[45] Date of Patent: Feb. 2, 1993

[54] CLOSURE WITH DISPENSING FITMENT AND SCREW-ON CAP

[75] Inventor: Douglas E. Pherigo, Loves Park, Ill.

[73] Assignee: J. L. Clark, Inc., Rockford, Ill.

[21] Appl. No.: 749,122

[22] Filed: Aug. 23, 1991

[51] Int. Cl.[5] ..... B65D 51/18; B65D 47/06

[52] U.S. Cl. ..... 220/256; 220/266; 220/359; 215/232; 215/251; 215/277; 222/565

[58] Field of Search ..... 215/232, 251, 277; 220/256, 254, 265, 266, 359, 356; 222/480, 556, 565

[56] References Cited

U.S. PATENT DOCUMENTS

| | | | |
|---|---|---|---|
| 1,454,170 | 5/1923 | Hyatt | 222/565 X |
| 2,576,416 | 11/1951 | Randlett | 222/565 X |
| 2,975,946 | 3/1961 | Westgate | 222/480 |
| 3,265,255 | 8/1966 | Mitchell | 222/565 X |
| 3,276,642 | 10/1966 | Johnson, Jr. et al. | 222/565 X |
| 3,664,536 | 5/1972 | Emery | 215/277 X |
| 3,874,580 | 4/1975 | Weatherhead | 220/266 X |
| 4,437,593 | 3/1984 | Bullock | 222/565 X |
| 4,482,071 | 11/1984 | Ishiwatari | 215/255 |
| 4,573,598 | 3/1986 | Perry | 215/204 |
| 4,984,700 | 1/1991 | Knickerbocker | 215/251 |

*Primary Examiner*—Gary E. Elkins
*Assistant Examiner*—Vanessa Caretto
*Attorney, Agent, or Firm*—Leydig, Voit & Mayer

[57] ABSTRACT

A plastic dispensing fitment and a plastic screw-on cap are connected in nested relation by an ultrasonic weld. When the cap is initially screwed onto the neck of a jar, the fitment is forced over the neck with a snap fit. When the cap is first unscrewed, the weld breaks to separate the cap from the fitment and enable removal of the cap from the jar while leaving the fitment attached to the jar.

4 Claims, 1 Drawing Sheet

CLOSURE WITH DISPENSING FITMENT AND SCREW-ON CAP

BACKGROUND OF THE INVENTION

This invention relates to a closure for a bottle, jar or the like for holding spices and similar food products. A closure of the same general type as that of the invention is disclosed in commonly assigned VerWeyst U.S. application Ser. No. 07/656,971, filed Feb. 19, 1991.

Such a closure comprises a plastic fitment having a top wall formed with at least one dispensing opening. The fitment is secured to the neck of the container with a snap fit and remains permanently attached to the container to enable product to be dispensed therefrom. Normally, the fitment is covered by a screw-on plastic cap. When product is to be dispensed from the container, the cap is unscrewed and removed from the container in order to expose the fitment.

In the closure disclosed in the aforementioned VerWeyst application, the fitment and the cap are shipped as separate units to the spice packer or other user of the closure. After the container has been filled, the fitment is snapped onto the container. Thereafter, the cap is screwed onto the container at a separate station.

SUMMARY OF THE INVENTION

The general aim of the present invention is to reduce shipping and assembly costs by providing a new and improved closure in which the cap and the fitment are shipped to the user as a single assembly which may be applied to the container by a single operation performed at a single station.

A further object of the invention is to provide a closure in which the cap and the fitment are a unitary assembly until the container is first opened, at which time the cap automatically separates from the fitment to permit removal of the cap from the container while leaving the fitment attached to the container.

A more detailed object is to achieve the foregoing by securing the cap and the fitment together as a unitary assembly by means of a bond which breaks and causes the cap to separate from the fitment when the cap is first unscrewed from the container.

The invention also resides in the provision of means for keeping the fitment centered within the cap while the two are being bonded together so that the fitment may subsequently snap onto the container when the cap is screwed on.

These and other objects and advantages of the invention will become more apparent from the following detailed description when taken in conjunction with the accompanying drawings.

DETAILED DESCRIPTION OF THE PREFERRED EMBODIMENT

Figure 3:
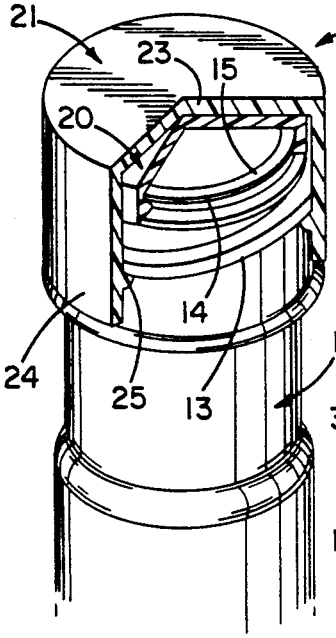
FIG. 3 is a perspective view of the container shown in FIG. 2, certain parts of the cap/fitment assembly being broken away and shown in section.

For purposes of illustration, the invention has been shown in the drawings as embodied in a closure 10 for closing a container 11 and for facilitating the dispensing of product from the container. Herein, the container is a glass or plastic jar having a cylindrical neck 12 with an external thread 13 (FIG. 3) and an upper external bead 14 whose upper end defines a sealing lip 15.

Figure 1:
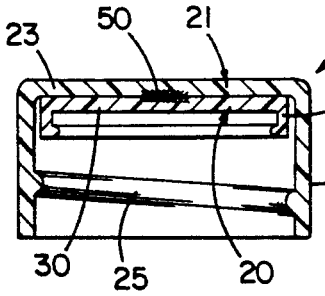
FIG. 1 is a cross-section taken axially through a new and improved cap/fitment assembly incorporating the unique features of the present invention.
Figure 2:
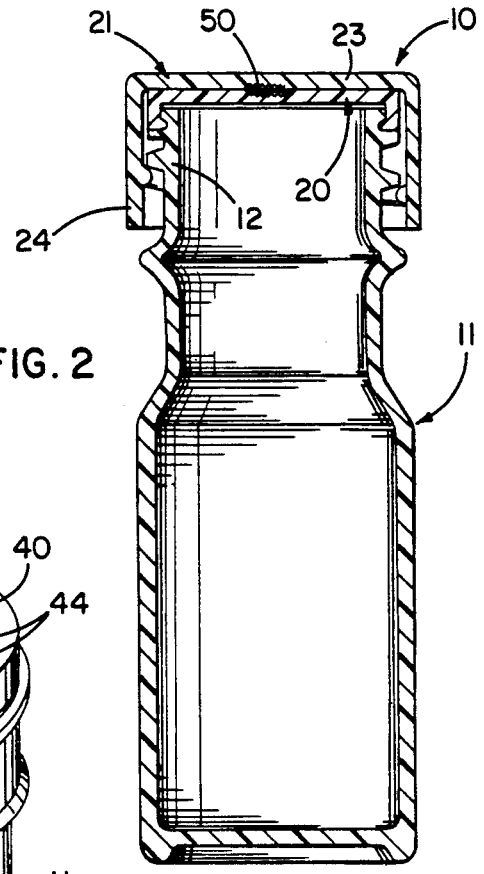
FIG. 2 is a cross-section taken axially through a typical container closed b the cap/fitment assembly of FIG. 1.

A dispensing fitment 20 is telescoped snugly with the neck 12 and, once applied, is intended to remain permanently with the jar 11. Normally, the fitment is covered by a screw-on cap 21 which may be unscrewed from the thread 13 and removed from the jar so as to expose the fitment and enable dispensing of the contents of the jar. The cap is molded of polypropylene or other thermoplastic material and includes a circular top wall 23 having a substantially flat lower surface. An annular skirt 24 is molded integrally with and depends from the periphery of the top wall and is formed with an internal thread 25 (FIG. 1) adapted to coact with the thread 13 of the jar.

Figure 4:
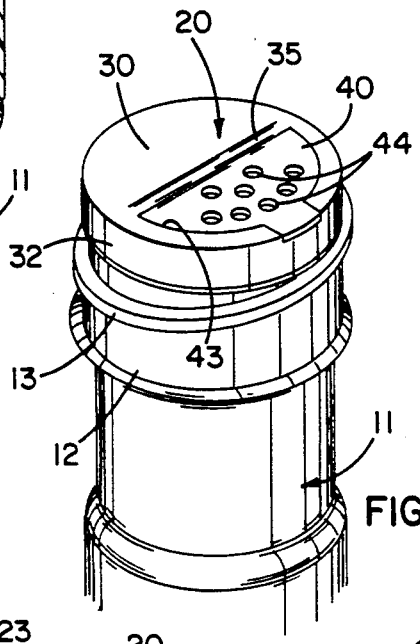
FIG. 4 is a perspective view similar to FIG. 3 but with the cap removed.
Figure 5:
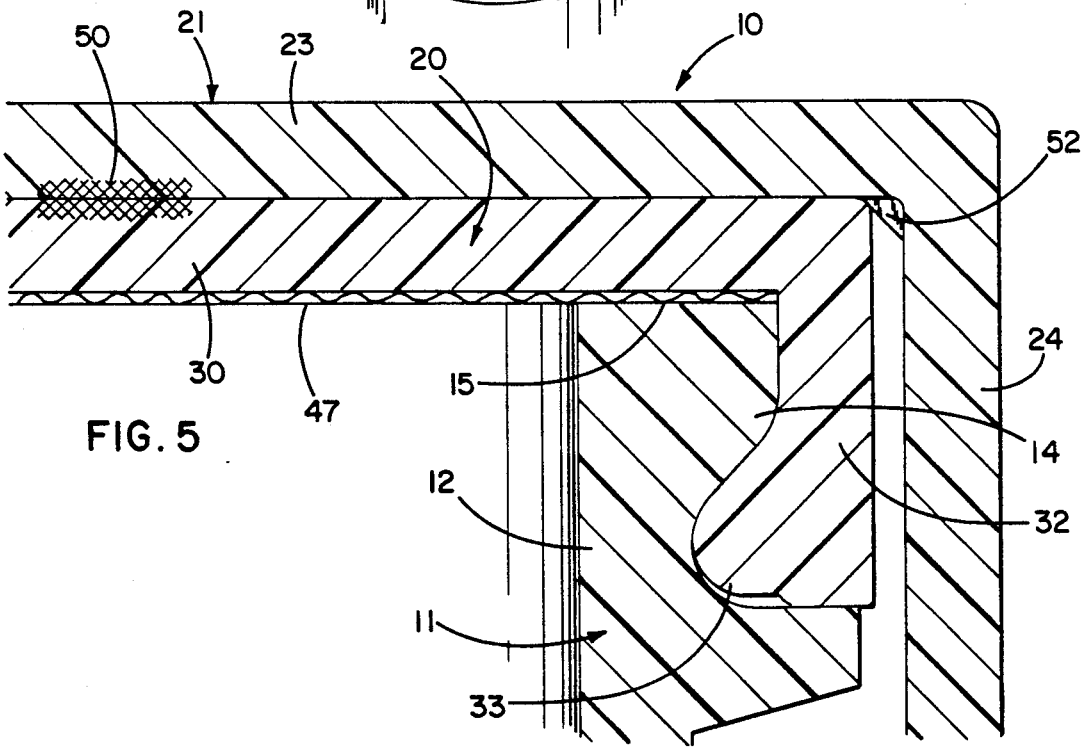
FIG. 5 is an enlarged fragmentary view of portions of the container and the cap/fitment assembly shown in FIG. 2.

The fitment 20 is circular, is of one-piece construction and is molded of resiliently yieldable plastic such as polypropylene. As shown in FIGS. 4 and 5, the fitment includes a circular top wall 30 formed with a substantially flat upper surface. Depending from the outer periphery of the top wall 30 is an annular skirt 32 of short axial length. An appropriately shaped rib 33 (FIG. 5) projects inwardly from the lower end portion of the skirt and is adapted to lock beneath the upper bead 14 of the jar 11 with a snap fit when the fitment 20 is applicated to the jar.

The fitment 20 itself may take many specific forms. In this particular instance, a groove 35 (FIG. 4) is formed in the upper side of the top wall 30 along a chord thereof and defines a living hinge for a flap 40 which is adapted to be swung between open and closed positions. While the hinge could lie along a major chord (i.e., a diameter) of the top wall, it herein extends along a chord which is offset slightly from a diameter so that the area of the fitment 20 on one side of the hinge is somewhat greater than the area on the other side of the hinge. A dispensing opening 43 (FIG. 4) is formed through the side of largest area and is generally semicircular in shape. The flap 40 is of the same shape as the dispensing opening 43 and is adapted to close the opening. When the flap is swung to its open position, a spoon may be inserted into the opening to remove the contents of the jar 11 or, alternatively, the contents may be poured out of the jar through the opening.

Several small holes 44 may be formed vertically through the flap 40. When the flap is in its closed position, the contents of the jar 11 may be dispensed by sifting the contents through the holes 44. Sift holes (not shown) also may be formed through the stationary area of the top wall 30, either in lieu of or in addition to the sift holes 44.

Completing the closure 10 is a laminated disc or liner 47 (FIG. 5) for engaging the upper lip 15 and initially sealing the jar 11. The disc establishes both a freshness seal and a tamper-evident seal for the jar. When the flap 40 is first opened, that portion of the sealing disc underlying the dispensing opening 43 is torn away so as to expose the opening.

The sealing disc 47 is circular and its diameter is just very slightly smaller than the diameter across the inner periphery of the skirt 32 of the fitment 20 so that the disc extends across the lip 15. The sealing disc is punched out of a sheet of material and is simultaneously pressed into the fitment prior to assembly of the fitment with the jar 11. Engagement of the lower peripheral edge portion of the disc with the upper side of the rib 33 captivates the disc loosely in the fitment until such time as the fitment is applied to the jar.

As described thus far, the fitment 20 and the cap 21 are essentially the same as disclosed in the aforementioned VerWeyst application. With the VerWeyst closure, the fitment and the cap are molded separately, the sealing disc 47 is pressed into the fitment and then the fitment and the cap are shipped as separate units to the packer who fills the jar 11. After the jar has been filled, the packer presses the fitment on the neck 12 of the jar 11 to cause the rib 33 of the fitment to snap beneath the bead 14 of the neck. Thereafter, the cap is screwed onto the jar to cover the fitment.

In accordance with the present invention, the fitment 20 and cap 21 are secured to one another after being molded and are shipped to the packer as a unitary assembly. After the jar 11 has been filled, the packer screws the cap onto the jar and, during final tightening of the cap, the fitment snaps onto the jar. When the cap is first unscrewed, it separates from the fitment and is free for removal from the jar but the fitment remains attached to the jar in order to serve its dispensing function.

More specifically, the fitment 20 and cap 21 are initially bonded together and preferably are bonded by an ultrasonic welding operation. To this end, the fitment is nested in the cap with the upper side of the top wall 30 of the fitment in face-to-face engagement with the lower side of the top wall 23 of the cap. An anvil and an ultrasonic welding horn (not shown) are closed against the lower side of the top wall 30 of the fitment and the upper side of the top wall 23 of the cap in order to heat and fuse the two plastics at a small circular area at the center portion of the cap and thereby form an ultrasonic weld 50 (FIG. 5). To facilitate formation of the weld, a small upwardly projecting protrusion (not shown) may be initially molded on the top wall of the central portion of the fitment in order to concentrate the ultrasonic energy in the area of the weld. After the weld has been made, the sealing disc 47 is pressed into the fitment. If desired, however, the disc may be placed in the fitment before the welding and the weld may be made through the disc.

Means are provided for holding the fitment 20 in a centered position in the cap 21 during formation of the weld 50. Herein, these means comprise a series of angularly spaced and generally triangular gussets 52 (FIG. 5) which extend across the junction between the top wall 23 and the skirt 24 of the cap. When the fitment is placed in the cap, it pilots into the annular row of gussets and is held in a fixed and uniform spaced relationship with the skirt 24 of the cap around the entire circumference of the skirt.

As discussed above, the fitment 20 and the cap 2 are shipped as a unit after the weld 50 has been made. Because the fitment is completely nested within the cap, the parts occupy less space than is the case when the parts are shipped separately and thus shipping costs are reduced.

After the jar 11 has been filled, the cap 21, with the fitment 20 welded thereto, is screwed onto the neck 12 of the jar. During final tightening of the cap, the rib 33 of the fitment slips past and then snaps beneath the bead 14 of the neck 12 in order to attach the fitment to the jar. Thus, the packer of the jar need merely screw the cap onto the jar and need not separately apply the fitment.

When the consumer first opens the jar 11 by unscrewing the cap 21, the relative motion between the cap and the axially fixed fitment 20 acts to break the weld 50. As a result, the cap separates from the fitment and may be removed from the jar while the fitment remains attached to the jar in order to perform its dispensing function. The cap may, of course, be screwed back onto the jar in a conventional manner when it is desired to re-close the jar.

I claim:

1. A container closure comprising a cap made of thermoplastic material and having a top wall and an internally threaded skirt integral with and depending from said top wall, a fitment made of thermoplastic material and having a top wall with at least one dispensing opening extending vertically therethrough, said fitment being disposed in said cap with the top wall of the fitment being located in face-to-face relation with the top wall of the cap, and means bonding the top wall of the fitment to the top wall of the cap, said bonding means comprising an ultrasonic weld between the plastic of the top wall of the fitment and the plastic of the top wall of the cap, said weld being sufficiently weak to break and release the cap from the fitment when the cap is twisted relative to the fitment.

2. A container closure as defined in claim 1 in which said fitment includes a skirt integral with and depending from the top wall of the fitment, and means on said cap and located between said fitment and said cap from centering said fitment in said cap.

3. A container closure as defined in claim 2 further including means on the skirt of the fitment and engageable with a container to hold the fitment on the container and to prevent removal of the fitment from the container when the cap is first unscrewed from the container.

4. A container having an externally threaded neck with an opening therein, a fitment telescoped with said neck and having means interlocking with said neck with a snap fit to hold said fitment on said neck, said fitment being made of thermoplastic material and having a top wall with at least one dispensing opening extending vertically therethrough, a cap made of thermoplastic material and having a top wall and an internally threaded skirt formed integrally with an depending from said top wall, said cap being screwed onto said neck and being positioned with the top wall of the cap disposed in face-to-face relation with the top wall of the fitment, and means bonding to top wall of the cap to the top wall of the fitment, said bonding means comprising an ultrasonic weld between the plastic of the top wall of the cap and the plastic of the top wall of the fitment, said weld being sufficiently weak to break and release said cap from said fitment when said cap is first unscrewed from the neck whereby the cap may be removed from the neck while the fitment remains on the neck by virtue of said snap fit.

* * * * *